United States Patent [19]

Rowell et al.

[11] 4,201,552

[45] May 6, 1980

[54] COAL-OIL SLURRY COMPOSITIONS

[75] Inventors: Robert L. Rowell, Amherst; Stephen R. Vasconcellos, North Amherst, both of Mass.

[73] Assignee: New England Power Service Company, Westborough, Mass.

[21] Appl. No.: 926,552

[22] Filed: Jul. 20, 1978

[51] Int. Cl.[2] ..... C10L 1/32

[52] U.S. Cl. ..... 44/51

[58] Field of Search ..... 44/51; 252/338, 311, 252/316, 308, 309

[56] References Cited

U.S. PATENT DOCUMENTS

| | | | |
|---|---|---|---|
| 2,359,325 | 10/1944 | McConnell et al. | 44/51 |
| 2,430,085 | 11/1947 | Spencer et al. | 44/51 |
| 3,902,869 | 9/1975 | Friberg et al. | 44/51 |
| 4,069,022 | 1/1978 | Metzger | 44/51 |

OTHER PUBLICATIONS

*The Condensed Chemical Dictionary,* 8th Ed., G. Hawley, p. 355, "Ethomeen", 1971, Van Nostrand Reinhold Co.

*Primary Examiner*—Winston A. Douglas
*Assistant Examiner*—Raymond K. Covington
*Attorney, Agent, or Firm*—Thompson, Birch, Gauthier & Samuels

[57] ABSTRACT

Coal-oil slurries are provided which contain a cationic stabilizer containing the group, $>N—CH_2—CH_2—O—$. The stabilizer can comprise a quaternary ammonium salt or a tertiary amine.

8 Claims, No Drawings

COAL-OIL SLURRY COMPOSITIONS

BACKGROUND OF THE INVENTION

This invention relates to stabilized slurries of particulate coal in a liquid hydrocarbon fuel and more particularly to such slurries containing a particular cationic surfactant.

Presently, industrial power plants utilize liquid hydrocarbons as fuel because of their high heat of combustion and because the liquid fuels can be obtained, depending upon source, in a form which is relatively nonpolluting. On the other hand, many power plants utilize solid fuels such as coal since it is much less expensive than liquid fuels. Attempts to utilize both types of fuels in admixture have not been successful because the dispersions obtained have not been sufficiently stable in that coke formation occurs upon standing so that it is difficult to pump the compositions from storage to the burner. In addition, clogging at the burner nozzles is a common problem.

Accordingly, it would be highly desirable to provide coal-liquid hydrocarbon fuel slurries which are stable in that the coal remains dispersed in the liquid. Furthermore, it would be highly desirable to provide such slurries which contain substantial amounts of coal, e.g. up to about 50 weight percent so that economic advantages over oil alone could be attained.

SUMMARY OF THE INVENTION

The present invention is based upon the discovery that certain cationic surfactants containing the group $>N—CH_2—CH_2—O—$ wherein the group forms part of a straight chain or cyclic ring are particularly effective for forming stable dispersions of coal in fuel oil. The dispersions are formed by mixing the fuel oil, a stabilizer and coal wherein the coal comprises up to about 50 weight percent of the dispersion. The dispersion is easily pumped without settling and, if settling occurs during storage, the surfactant permits redispersion of the coal upon mixing.

DESCRIPTION OF SPECIFIC EMBODIMENTS

The cationic surfactant utilized in the present invention comprises a quaternary ammonium salt or a tertiary amine which includes the group $$>N—CH_2—CH_2—O—$$

which group can be part of a straight chain in the case of a tertiary amine or part of a cyclic ring in the case of a quaternary ammonium salt. The tertiary amines useful in the present invention are represented by the formula:

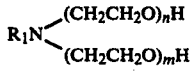

wherein $R_1$ is alkyl containing from 12 to 22 carbon atoms. The polyethylene oxide groups should be relatively long so that m+n totals between 5 and 20, preferably between 5 and 10. When used in the presence of water, the tertiary amines exist as quaternary ammonium hydroxide compounds.

The quaternary ammonium salt surfactants have the general formula:

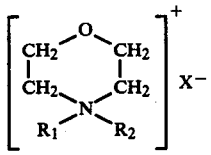

wherein X is a polar anion including $OSO_3C_2H_5$, $CH_3(CH_2)_{16}COO^-$, $Cl^-$, $Br^-$ or the like, $R_1$ is a long chain alkyl containing from 12 to 22 carbon atoms, preferably from 12 to 18 carbon atoms and $R_2$ is a short chain alkyl having from 1 to 5 carbon atoms and derives from the anion that forms the quaternary ammonium salt.

The stabilized coal-oil slurry compositions made in accordance with the present invention using pulverized coal in hydrocarbon oil form stable dispersions at coal concentrations up to about 60 weight percent based on the weight of the mixture. The amount of stabilizing surfactant agent in the slurry is typically between about 0.1% and 1.0% by weight of the weight of coal used in the slurry, preferably between about 0.15% and 0.25% by weight with some variation depending on the exact coal and oil used and the degree of effectiveness of stabilization desired. Increased amounts of stabilizer can be employed, but the small improvement thereby obtained makes the increased cost of stabilizer uneconomical. The stabilizers have been found to be effective on pulverized coal prepared as a power plant fuel by grinding according to the industrial standard 80% through 200 mesh. However, the effectiveness of the stabilizers has been precisely demonstrated using an industrially ground coal substantially all of which passes through a 170 mesh and 95% by weight of which further passes through 200 mesh. Of course, for a given weight percent coal, more stable dispersions are obtained when the coal is more finely ground.

The coal-oil slurry or dispersion is prepared by heating the oil to a temperature of 50° C., and adding the stabilizer to the oil in the desired quantity based upon the weight of the amount of coal that is to be subsequently added. The pulverized coal is then added to the oil-stabilizer composition and the resultant composition is stirred vigorously, usually within less than about 30 minutes, to ensure uniform mixing. The resulting suspension is then ready for use. In one aspect of this invention, the oil is heated moderately to a temperature of between about 35° C. and 50° C. prior to mixing the stabilizer and coal therewith since it has been found that moderate heating promotes initial homogeneous mixing of the oil and coal.

Petroleum fuel oils suitable for use in the formulation are heating oils such as are generally designated No. 6 fuel oil, No. 2 fuel oil, other petroleum derivatives used as heating oils or the like.

The pulverized coal may be of various types of coal, e.g. bituminous, anthracite, or semi-bituminous. Other finely-divided solid carbonaceous materials may be used, e.g. coke either from coal or petroleum.

In testing the dispersion, the stabilized coal-oil slurry, maintained at a temperature of 50° C. does settle out on standing over a 24-hour period, but the amount of sedimentation in the stabilized slurry as measured by the weight percent coal in the bottom layers is less than that in a coal-oil slurry with no stabilizer present. Moreover, the stabilized coal-oil slurry has improved rheological or flow properties over that of the corresponding unstabilized slurry as measured by the time required for the slurry to flow through a small orifice.

The composition of this invention also can contain up to 5% water and these compositions can be pumped through pipelines for transportation to where the coal-oil mixture is to be burned. Water in small amounts improves the effectiveness of the stabilizers and under some circumstances, improves the process of combustion by contributing to the dispersion of the coal in the flame. However, excessive concentrations of water has the adverse effect of removing available heat according to the latent heat of vaporization and heat capacity. In addition, it has been found that excessive amounts of water leads to microcluster formation and destabilization of the coal-oil mixture. The stabilizers improve the redispersibility of suspensions of coal that have settled out on storage.

Particularly suitable stabilizers used in the present invention include N-soya-N-ethyl morpholinium ethosulfate represented by the formula:

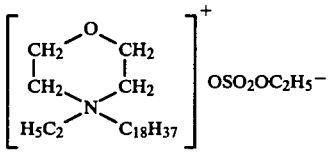

available under the trademark, Atlas G-271 the compound:

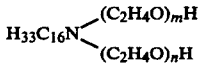

wherein m+n is 10 available under the trademark Ethomeen C-20 and the compound of the formula:

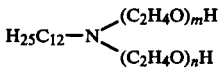

wherein m+n is 5 and is available under the trademark Ethomeen C-15.

The following examples illustrate the present invention and are not intended to limit the same.

EXAMPLE I

This example illustrates the effectiveness of the preferred stabilizers, Atlas G-271, Ethomeen C-20 and Ethomeen C-15.

An apparatus for measuring sedimentation comprises a column 50 cm high with an inner diameter of 20 mm, jacketed along its entire length through which a heat exchange liquid can be cycled. A stopcock bore, 10 mm in diameter, is positioned attached to and below the column and a pycnometer is used to measure density of samples obtained via the stopcock. The column is thermostated using water at 50° C. The apparatus was used to determine the suspending effectiveness of various surfactants for coal-oil slurries. The coal was a finely-divided bituminous coal that was oven-dried for 6 hours at 100° C. The particle size of the coal ranged up to about 110 microns and 70% of the coal had a particle size less than 50 microns. The density of the coal was 1·22 g/cm$^3$. A low sulfur oil having a density of 0.9148 g/cm$^3$ was employed for admixture with coal to form a dispersion. All dispersions were prepared as 25 weight percent coal-oil dispersions by weighing a 250 ml beaker, adding approximately 125 ml of oil, and then determining the weight of the oil using a triple-beam balance. The necessary amount of coal to make a 25 weight percent dispersion was then calculated, and the dried coal weighed on a Mettler H-10 analytic balance to the calculated amount. The oil was then heated on a hot plate to a temperature of 50° C., and a surfactant, shown in Table I, added to the oil in the quantity to yield 0.25% additive by weight of the suspension. This was accomplished by calculating the amount of additive needed, and then using the Mettler balance to weigh out the desired amount. All surfactants were used as supplied by the manufacturer. The coal was added to the hot oil, and stirred vigorously by hand for five minutes to ensure uniform mixing. The resulting suspension was then poured into the apparatus and readings taken by filling the pycnometer and weighing the dispersion at given time intervals over a 24 hour period. To expedite experimentation, four columns were connected in series and heated with water at 50° C. using an insulated bath and a circulating heater pump, with one column always containing an unstabilized dispersion to serve as a control.

The following procedure is used to obtain sample measurements:

A. Pycnometer Calibration

1. Weigh the complete pycnometer on an analytic balance.
2. Fill pycnometer with distilled $H_2O$ at known temperature and density. Filling is accomplished by adding fluid to the vessel, then inserting the cap so that the overflow is ejected through the top. Wipe off the excess so that it is level with the top of the cap.
3. Weigh the pycnometer and water.
4. From the weight difference, the weight of water in the pycnometer is known. The pycnometer volume can then be calculated from the density of water at the temperature of the measurement.

B. Density Measurement

1. Make sure column and suspension are at correct temperature.
2. Add suspension to column, with stopcock closed.
3. Allow for temperature equilibration.
4. Place pycnometer vessel minus cap under column tip.
5. Gradually turn stopcock to "open" position until a slow stream of suspension flows into the pycnometer. Fill to about 90% capacity. Close stopcock.
6. Insert cap in vessel, wipe off the overflow, and weigh the filled pycnometer using an analytic balance.
7. Knowing the suspension weight and knowing the volume of the pycnometer, the density of the suspension can be calculated.
8. Wipe the inside of the tip clean before taking the next sample. Also, clean out the bore of the closed stopcock.

C. Drain Time Measurement

1. Record the suspension height.
2. At a set time, open the stopcock.
3. Record the time required to completely drain the column. Column will be drained when flow ceases from the tip.

Drain times and weight percents at 24 hours were determined, and used to calculate drain time ratios and sedimentation ratios. The results are listed in Table II.

In Table II, SR is the sedimentation ratio which is the ratio of the weight percent of coal of the stabilized coal-oil dispersion against the weight percent of the unstabilized dispersion. A value of one indicates no effect on the settling rate by the surfactant whereas a value less than one indicates a reduction of the settling rate due to the surfactant. The drain ratio time ($t_d$) is the time required to drain a column containing a stabilized dispersion divided by the time required to drain a column containing a control dispersion with no surfactant. The product of these two parameters provides a convenient means for determining the effectiveness of a surfactant. As shown in the Tables, the cationic surfactants, as a class, are the most effective in forming the most stable coal-oil dispersions and within that class, Atlas G-271, Ethomeen C-20 and Ethomeen C-15 are the most effective stabilizers.

TABLE I

| Sample | Structure |
|---|---|
| | LIST OF SURFACTANTS |
| | A. ANIONIC SURFACTANTS |
| Alepal CO-436 | $NH_4^+$ salt of sulfite ester of alkylphenoxy-polyol |
| Span 60 | Sorbitan Monostearate |
| Span 40 | Sorbitan Monopalmitate |
| Blancol N | Sodium Salt of condensed naphthalene sulfonic acid |
| Deriphat 170C | Sodium salt of lauryl myristyl-$\beta$-amino propionic acid |
| | B. CATIONIC SURFACTANTS |
| CTAB | $CH_3(CH_2)_{15}N(CH_3)_3Br$ |
| CTAC | $CH_3(CH_2)_{15}N(CH_3)_3Cl$ |
| CTAS | Cetyl trimethyl ammonium stearate |
| Triton X-400 | Benzylalkonium chloride |
| Ethomeen C-15 | $CH_3(CH_2)_{14}N(C_2H_4O)_mH(C_2H_4O)_nH$ |
| Ethomeen C-20 | $CH_3(CH_2)_{19}N(C_2H_4O)_mH(C_2H_4O)_nH$ |
| Atlas G-271 | N-soya N-ethyl morpholinium ethosulfate |
| | C. NONIONIC SURFACTANTS |
| Merpol SH | $CH_3(CH_2)_{12}(OC_5H_4)_8OH$ |
| Merpol HC | $CH_3(CH_2)_7CH{=}CH(CH_2)_8(OC_5H_4)_{20}OH$ |
| Brij 78 | Polyoxyethylene (20) Oleyl ether |
| Tween 20 | Polysorbate 20 Polyoxyethylene (20) sorbitan monolaurate |
| Tetronic 1104 | Polyol |

TABLE II

| Sample | SR | $t_d$ | $t_d$xSR |
|---|---|---|---|
| | RESULTS OF SURFACTANT SCREENING | | |
| | ANIONICS | | |
| Alepal CO-436 | .696 | .66 | .459 |
| Span 60 | .822 | .72 | .529 |
| Span 40 | .832 | .76 | .632 |
| Blancol N | .976 | .92 | .898 |
| Deriphat 170C | .888 | .86 | .764 |
| | CATIONICS | | |
| CTAB | .794 | .70 | .556 |
| CTAC | .754 | .64 | .483 |
| CTAS | .605 | .62 | .375 |
| Triton X-400 | .721 | .69 | .498 |
| Ethomeen C-15 | .700 | .50 | .350 |
| Ethomeen C-20 | .583 | .48 | .280 |
| Atlas G-271 | .621 | .44 | .273 |

TABLE II-continued

| Sample | SR | $t_d$ | $t_d$xSR |
|---|---|---|---|
| | RESULTS OF SURFACTANT SCREENING | | |
| | NONIONICS | | |
| Merpol SH | .765 | .60 | .459 |
| Merpol HC | .790 | .64 | .506 |
| Brij 78 | .832 | .77 | .641 |
| Tween 20 | .917 | .88 | .807 |
| Tetronic 1104 | .655 | .70 | .459 |

EXAMPLE II

This example illustrates the minimum concentration of surfactant needed for a stable dispersion of 25 weight percent coal in No. 6 fuel oil.

Utilizing the device described in Example I for obtaining density measurements and drain time, coal-oil dispersions were prepared with Atlas G-271, Ethomeen C-20 and Ethomeen C-15. In each instance, the oil was heated to 50° C. and the surfactant then was added to the oil followed by addition of coal to obtain a sample having a volume of about 50 cc. The coal was finely divided bituminous coal described in Example I and the oil was that employed in Example I. The resultant composition then was agitated for about 5 minutes to form a homogeneous dispersion which was then poured into the jacketed column wherein its temperature was maintain at 50° C. The amount of surfactant varied and was based upon the weight of the suspension while the amount of coal in all cases comprised 25 weight percent based upon the weight of coal and oil. Satisfactory suspensions are those having a sedimentation ration (SD) of 0.65. In each instance, the effective minimum concentration was 0.16 weight percent.

We claim:

1. A coal-oil slurry which contains a cationic stabilizer having the group, $>N—CH_2—CH_2—O—$ in an amount effective to form a stable slurry containing up to about 50 weight percent coal; said stabilizer being selected from the group consisting of a tertiary amine and a quaternary ammonium salt.

2. The slurry of claim 1 wherein the stabilizer is a tertiary amine of the formula:

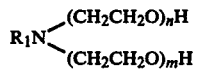

wherein $R_1$ is alkyl containing from 12 to 22 carbon atoms and the sum of m and n is from 5 to 20.

3. The slurry of claim 2 wherein $R_1$ has 16 carbon atoms and m+n is 10.

4. The slurry of claim 2 wherein $R_1$ has 12 carbon atoms and m+n is 5.

5. The slurry of claim 1 wherein the stabilizer is N-soya-N-ethyl morpholinium ethosulfate.

6. The slurry of any one of claims 1 through 5 wherein the stabilizer comprises between about 0.1 and 1.0 weight percent based upon the weight of coal.

7. The slurry of any one of claims 1 through 5 wherein the slurry contains up to 5 weight percent water.

8. The slurry of claim 6 wherein the slurry contains up to 5 weight percent water.

* * * * *